United States Patent [19]

Hubers

[11] 4,106,285

[45] Aug. 15, 1978

[54] METHOD FOR REGULATING THE DRIVING POWER OF AN EXPANSION ENGINE AND EXPANSION ENGINE FOR CARRYING OUT THIS PROCESS

[76] Inventor: Cornelis Hubers, 11, Slingerlaantje, Harderwijk, Netherlands

[21] Appl. No.: 631,404

[22] Filed: Nov. 12, 1975

[30] Foreign Application Priority Data

Nov. 20, 1974 [NL] Netherlands ..... 7415108

[51] Int. Cl.[2] ..... F02G 3/02

[52] U.S. Cl. ..... 60/39.63; 60/39.67; 60/599; 123/119 CD

[58] Field of Search ..... 60/39.63, 39.61, 39.67, 60/599, 615, 611; 123/119 CD

[56] References Cited

U.S. PATENT DOCUMENTS

| | | | |
|---|---|---|---|
| 940,474 | 11/1909 | Piestrak | 60/39.63 X |
| 980,801 | 1/1911 | Kraus | 60/39.63 X |
| 2,364,330 | 12/1944 | Weigel | 60/39.67 X |
| 2,459,447 | 1/1949 | Milliken | 60/39.63 |
| 2,548,508 | 4/1951 | Wolfner | 60/39.67 X |
| 2,575,683 | 11/1951 | Price | 60/39.67 X |
| 2,688,230 | 9/1954 | Milliken | 60/39.63 |
| 2,709,336 | 5/1955 | Nilsson | 60/39.63 |
| 3,018,617 | 1/1962 | Kelgard | 123/119 CD |
| 3,163,984 | 1/1965 | Dumont | 60/611 |
| 3,224,186 | 12/1965 | Wood | 60/599 |
| 3,595,013 | 7/1971 | Brille | 123/119 CD |
| 3,651,641 | 3/1972 | Ginter | 60/39.63 X |
| 3,712,282 | 1/1973 | Isley | 123/119 CD |
| 3,780,528 | 12/1973 | Brandenburg | 60/39.63 X |
| 3,932,987 | 1/1976 | Munzinger | 60/39.63 X |
| 3,939,652 | 2/1976 | Hubers | 60/39.63 |

*Primary Examiner*—Clarence R. Gordon
*Attorney, Agent, or Firm*—Karl W. Flocks

[57] ABSTRACT

A method for controlling the driving power of an expansion engine and an expansion device for carrying out said method, said expansion device being driven by the combustion gases of a separate combustion device to which fuel and air are supplied, said air being supplied to said combustion device by a supercharger via a cooling installation and after compression in said expansion engine the temperature of said compressed air being modified by its cooling in said cooling installation in such a way that the power control takes place by setting the compression temperature of said compressed air at a chosen constant combustion temperature of the combustion gases in said combustion device.

7 Claims, 5 Drawing Figures

METHOD FOR REGULATING THE DRIVING POWER OF AN EXPANSION ENGINE AND EXPANSION ENGINE FOR CARRYING OUT THIS PROCESS

The invention relates to a method for regulating the driving power of an expansion device, which is driven by combustion gases formed in a separate combustion engine, to which fuel and air are supplied, and also relates to an expansion engine for carrying out said method.

With the usual combustion engines, a rather high degree of compression is needed to obtain a sufficiently high efficiency. This high degree of compression limits the possibility of increasing the filling by supplying heat. Thus, a narrow, highly stretched ribbon-shaped diagram is obtained.

With the usual combustion engines, highest possible combustion temperatures are necessary to obtain a sufficiently great filling, as the average effective piston pressure is dependent thereon. In consequence of said high combustion temperatures, said combustion engines are submitted to high thermal loads and a great cooling loss occurs.

For obtaining a good volumetric efficiency, use is often made of preliminary supercharging. This, however, leads to an important and very great rise of the compression pressure in favour of a relatively small rise of the average effective piston pressure, whereas this rise of the compression pressure does not have a favourable influence on the efficiency of the expansion engines.

The object of the present invention is to avoid said drawbacks and to operate an expansion engine in such a way, that the efficiency can be kept at a favourable level. This is obtained by the method according to the invention, in that the air is supplied to the compression engine through a supercharger and a cooling installation and, after compression, to the combustion device, the temperature of the supercharging air supplied by the supercharger being modified by interim cooling in the cooling installation in such a way, that the power regulation by setting the compression temperature of the supercharging air takes place at a chosen constant combustion temperature of the combustion gases in the combustion device. Thus, dependent on the supercharging pressure, a regulation of the power of the expansion engine is obtained, from running without load to running under a light load, the cooling installation being entirely out of operation until a power is reached, dependent on the compression pressure, which is greater than the minimal power, which the expansion engine can supply at the chosen constant combustion temperature. If so desired, this minimal power can be set by setting the combustion temperature of the combustion gases, while maintaining the working pressure, at a lower constant temperature by supplying less fuel to the combustion device.

The charging pressure may be variable, whereas according to the invention the aspiration of fresh air by the supercharger can be set in such a way, that a full heat filling of the expansion engine, and the expansion in the supercharger continues just so far so that the pressure of the air outside is reached. Thus, at a certain cross load of the expansion engine, the efficiency thereof is increased by the complete expansion.

A favourable embodiment of the method according to the invention is characterized, in that the mechanical filling is made variable in such a combination with the compression degree, the supercharging degree and the basic expansion degree of the expansion engine, that when the filling is increased under the influence of a higher than normally tolerable combustion temperature of the combustion gases, the average piston pressure can be further increased, without a decrease of the efficiency. By using temporarily a higher thermal load than the nominally highest thermal load, for which the expansion engine is nominally designed, the average pressure and thus the power of the expansion engine can be increased considerably. e.g. at a preliminary supercharging degree 3, a compression degree 8 and a basic temperature of 1273° K, an increase of the heat filling to a temperature of 1500° K can lead to an increase of the average pressure by 50%, namely from 12 to 18 atmospheres.

According to the invention, the mechanical filling can be decreased to such an extent, that the supercharger is unloaded so far, that without surplus of energy it only functions as an air exchanger, which causes scavenging at a chosen initial pressure. Thus, at low power, the supercharger can run without load as much as possible. By a favourable setting of the preliminary supercharging pressure, of the preliminary supercharging temperature and of the filling, a higher efficiency is thus obtained.

The expansion engine for carrying out the method according to the invention, which expansion engine is provided with a separate combustion device having a supply line for the compressed air and the fuel, with an ignition installation for the fuel, and with valves operated by a camshaft for the supply of the combustion gases to the expansion engine, is characterized in that a supercharger is provided, which supplies the air which is precompressed in the supercharger, through a cooling installation to the expansion engine, said cooling installation having an inlet and an outlet for a cooling medium, a valve, slide or such regulation means being present in said inlet and outlet for regulating the cooling medium supplied to the cooling installation, which is operated by the temperature or the pressure in the combustion engine.

The regulation means for the regulation of the cooling medium supplied to the cooling installation may consist of a casing which is connected to the combustion device by a pipe, a spring-charged plunger with a cam or collar at both its ends being provided in an aperture of said casing, said plunger operating a regulation means of the regulation device.

Instead of a mechanical regulation device another mechanical device or an electrically functioning device can be used.

A favourable embodiment of an electrically functioning regulation device is characterized in that it consists of a manometer connected to the combustion installation, said manometer co-operating with two contacts, which are placed each in a current circuit connected to a servomotor, which operates a regulation means of the regulation device. This regulation device may also be carried out in such a way, that the expansion engine can run under overload. For that purpose, according to the invention, a contact may be provided at both sides of the contacts co-operating with the manometer, said contacts being placed each in a current circuit connected to the servomotor.

Another method of letting the expansion engine run under overload consists in that the cams for the operation of the valves, which supply the combustion gases to the cylinder, are adjustable.

If too much running under overload of the expansion engine is to be avoided, a thermostat can be provided according to the invention in the combustion installation, said thermostat influencing the fuel supply in such a way, that only as much fuel is supplied to the combustion installation as corresponds to the quantity of fuel with which the maximum power, for which the expansion engine is designed, can be reached.

The advantages of the above-described embodiments of the expansion engine according to the invention will be explained hereinafter with reference to the drawing, in which by way of example some embodiments of the expansion engine according to the invention are shown schematically.

Figure 1:
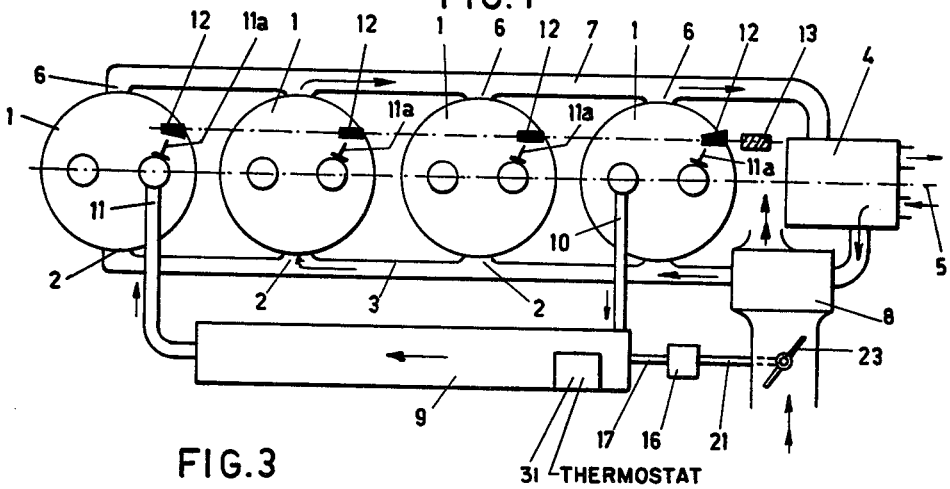
FIG. 1 shows a top view of the expansion engine.

The drawing shows an expansion engine, where the combustion of the fuel takes place in a separate combustion installation, which can be carried out in any known way. Use is preferably made, however, of a combustion installation, which is divided by a partition into two chambers, compression air under pressure being supplied from the cylinders 1 to the one chamber, and at least one burner being provided in the partition in such a way, that the air from the first chamber, which is carried out as a buffer, can stream into the second chamber only through the burner combination, so that a complete combustion of the fuel takes place. The second chamber is connected to the cylinder of the expansion engine, which is provided in a known way with the usual valves.

As results from FIG. 1, air is let into the cylinders 1 through scavenging ports 2 from a channel 3 which functions as a buffer, said air being brought to a relatively high filling pressure in a supercharger 4 coupled to the engine axis 5, said supercharger 4 aspiring and compressing fresh air from the outside. This supercharger is driven by the exhaust gases, which stream through exhaust ports 6 and a channel 7 to the supercharger 4. The channel 7 is so long that the supercharger 4 can be placed free, so that one single supercharger is sufficient, which can easier be coupled to the engine axis 5 than superchargers, which are connected directly to the exhaust ports.

The channel 7 has such a volume, that no or practically no streaming losses occur. This implies that the supercharger is not driven by the so-called "push"- or "impulse"-system, but approximately according to a so-called "equal pressure"-system. It is observed that the volume of the channel 7 is not chosen unnecessarily large, but is kept as small as tolerable.

In a filling channel 3, which also functions as a buffer and which is connected to the supercharger 4, a cooling installation 8 is provided, which cools the filling air under nominally equal pressure.

The regulation of the power of the expansion engine takes place by regulating the fuel supply to the burner of the combustion device 9, which for reasons of clarity is drawn beside the expansion engine.

Each cylinder 1 is connected by a line 10, of which only one is shown, to the combustion installation 9. Through these lines 10, the hot compression air expelled from the cylinder 1 streams to the combustion installation 9, in which the air expands until the almost constant pressure prevailing in this combustion installation, so that a greater volume of gas can be supplied as filling to the expansion engine than has been expelled from the cylinders as compression volume.

Each cylinder 1 is also connected by a line 11, of which also only one is shown, to the combustion device 9. Through said lines, the combustion gases formed in the combustion installation stream through operated valves 11*a* to the cylinders 1. These valves supply a certain filling (so-called mechanical filling) to each of the cylinders. In the shown embodiment of the expansion engine, said valves are operated by cams 12 which are provided on a camshaft 13 driven by the engine axis.

The starting of the expansion engine can be done by means of compressed air from a storage reservoir or by a starting motor. In the latter case, air is aspired from the outside, compressed and expelled to the combustion installation. As soon as there is a certain streaming, the fuel supply to the combustion device is opened and the fuel is ignited. After a few strokes, the desired pressure is reached in the expansion engine.

During the starting, the cooling installation 8 stays out of operation until the pressure in the heater has reached the desired, set pressure. From the moment on that the compression line passes by the filling line 3, starting power is supplied under the influence of the rising pressure (see the circuits *a, a', a''* . . . in FIG. 2). In the meantime also the supercharging pressure rises, so that the circuit of the expansion engine starts higher and higher in pressure, as is shown by *b, b', b''* . . . From the moment on that the diagram is sufficiently great, the engine runs. At a light load, the power is regulated according to the circuit *c, c', c''* in FIG. 2.

From the moment on that the pressure set as maximum is reached, the cooling installation 8 starts to work so that, dependent on the power desired, the supercharging pressure drops gradually with the temperature until, at maximum power, the supercharging temperature has reached the minimum set. The power regulation, which always takes place by the regulation of the fuel supply to the combustion installation, expresses itself until that point in the diagram by the displacement of the compression line to the Y-axis according to the lines *d, d', d''* . . . .

Figure 2:
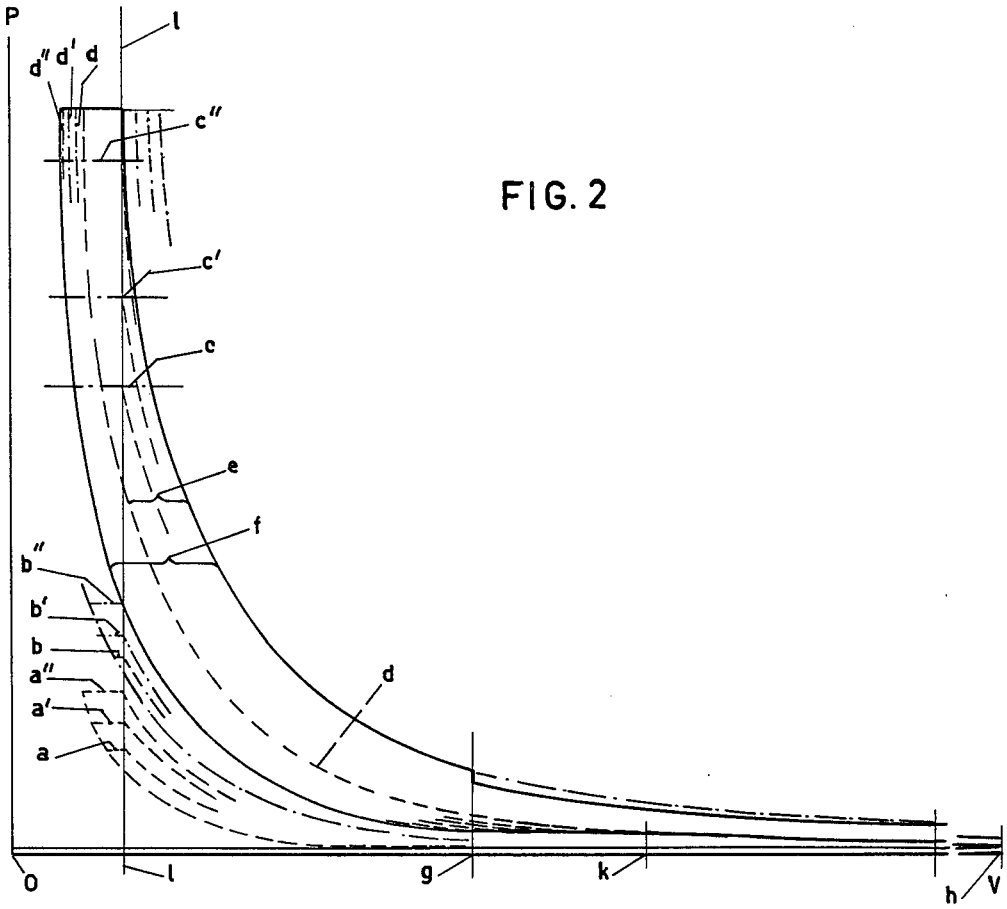
FIG. 2 shows a pv-diagram.

In further explanation of FIG. 2 it is observed, that by the brace *e* the maximum filling of the diagram of a diesel-engine is indicated, whereas the brace *f* indicates the maximum filling of the expansion engine according to the invention, to which the surface of the supercharging surplus must be added. The cylinder volume is indicated by the line *o–g*, the volume of the supercharger by the line *o–h*, and the maximum cooling by the line *g–k*.

The decrease of the supercharging pressure by cooling of the filling air in the cooling installation takes place in proportion with the increase of the power. This can be done mechanically by means of the regulation device shown in FIG. 3, or electrically by means of the regulation device shown in FIG. 4.

Figure 3:
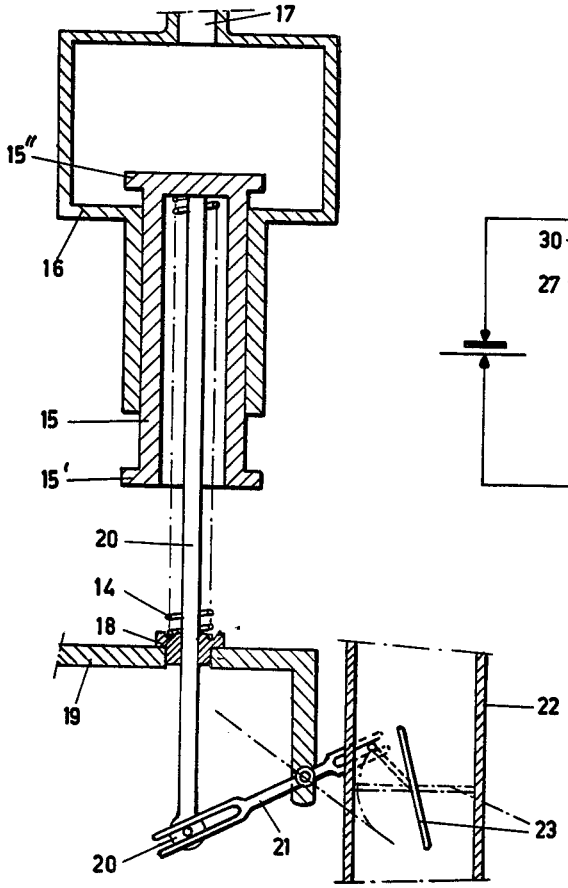
FIG. 3 shows at an enlarged scale a cross-section of an embodiment of the regulation device for regulating the supply of the cooling medium.

As results from FIG. 3, the regulation device shown therein for the regulation of the cooling medium supplied to the cooling installation, consists of a casing 16, which is connected through a line 17 to the interior of the combustion device 9. In a cylindrical projection of this casing 16, a slidable sealing plunger 15 is provided, which has at its ends a cam 15', respectively 15''. The plunger 15 has a plunger rod 20 which is loaded by a pre-stretched spring 14. The plunger rod 20 passes through a hole of a spring cup 18, on which the free end of the spring 14 rests. The spring cup 18 is provided in a stationary part 19 of the expansion engine. The end of the plunger rod 20, which projects from the hole of the spring cup 18, is connected by a rod 21, which is rotatable around a stationary pivot, to a valve 23 which is provided in the supply line 22 leading to the cooling installation. The spring 14 is pre-stretched to such an extent, that it exerts on the plunger a pressure, which equals a pressure prevailing in the connection chamber, which equals the maximum working pressure. As long as this pressure is not reached, the spring 14 pushes the plunger 15 so far upwards, that the cam or collar 15' lies against the casing 16. When the pressure in the casing rises, the plunger moves downwards and compresses the spring. The stroke of the plunger is limited by the cam or collar 15'' thereof, which then comes to lie against the inner side of the casing 16. Because of the compression of the spring 20 a difference of tension occurs, which, however, is kept as amall as possible.

When the pressure in the combustion device rises, the downwards moving plunger pushed against the rod 21, so that the valve 23 rotates, so that the cooling medium, e.g. air, can stream through the supply line 22 to the cooling installation 8, in order to cool the filling air supplied by the supercharger. When the pressure in the combustion device drops, the plunger moves upwards in the casing, so that the cooling is switched off when the cam or collar 15' touches the outer side of the casing.

Figure 4:
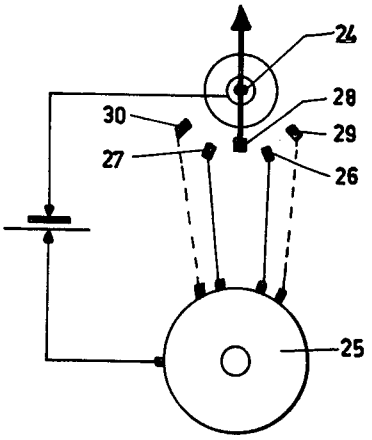
FIG. 4 shows schematically and at an enlarged scale another embodiment of the regulation device for regulating the supply of the cooling medium.

A more accurate regulation of the pressure in the combustion device can be obtained with the electric regulation shown in FIG. 4. Here, the casing 16 is replaced by a manometer 24, which is provided with contacts 26 and 27 placed in the current circuit of a servomotor 25, said contacts being provided at some distance at both sides of the contact 28 of the manometer pointer. This distance between the contacts 26 and 27 on the one hand and the contact 28 on the other hand serves to prevent that too small pressure oscillations, as a result of the buffer action in the combustion device 9, are reacted on.

When the pressure in the combustion device has not yet reached its prescribed maximum during the starting of the expansion engine or at low power thereof, the cooling installation 8 stays out of operation. The contact 28 of the manometer pointer entirely passes by the relative contact 26, and comes into touch with a contact 29, which is not connected in the current circuit of the servomotor 25. When the pressure in the combustion device becomes too high, the contact 28 of the manometer comes into touch with the contact 27, so that the cooling installation starts to work. If the pressure remains high, the contact 28 passes by the contact 27 and it comes into touch with the contact 30, which is not connected in the current circuit of the servomotor, so that the cooling installation is fully in operation.

It is observed that instead of the described mechanical regulation device, also other mechanical regulation devices can be used, whereas instead of a manometer a thermocouple or other electric regulation device can be used.

From the moment on that the cooling installation is fully in operation so when the cam or collar 151 lies against the outer side of the casing 16, or when the contact 28 has entirely passed by the contact 27, an extra fuel supply will cause a rise of the temperature and of the pressure in the combustion device, so that the expansion engine will supply extra power. This extra power may serve as temporary increase of the normal maximum power of the expansion engine. By incorporating in the combustion engine a thermostat 31, which prevents that more fuel can be supplied to the combustion device than for reaching the normally desired maximum power of the expansion engine, for which the latter is designed, the rise of the temperature and of the pressure in the combustion engine can be prevented.

Another possibility to carry out the expansion engine in such a way that it can be temporarily overloaded, consists in that a temporary increase of the mechanical filling of the cylinders of the expansion engine is provided. In the diagram of FIG. 2, the filling line 1 is then temporarily displaced to the right, thus further away from the Y-axis. This can be done, e.g., by a regulation similar to that of FIG. 4, which is derived from the working pressure in the combustion device, by connecting the contact 29 beside the contact 26 to the servomotor 25. After a small rise of the pressure, the contact 28 of the manometer comes into touch with this contact 29, so that the new regulation circuit comes into operation, which, dependant on the rise of the pressure in the combustion engine, increases the mechanical filling, e.g. by adjusting the camshaft 13, which therefore must be adjustable in such a way, that a longer filling time is reached.

In a corresponding manner, a contact 30 connected to the servomotor can be provided in FIG. 4 beside the contact 27, in order to reduce the filling time of the cylinders via the adjustable cams 12 when the pressure in the combustion device is lower than the maximum pressure, for which the expansion engine is designed. At low power, this is a means to keep the pressure at such a level, that the expansion engine itself has a high efficiency, at which the supercharger can be short-circuited. The supercharger namely supplies a certain energy surplus, because at the low expansion degree of the expansion engine, a rather high exhaust pressure is available to feed the supercharger, as results from the diagram of FIG. 2. When at low power of the expansion engine, the supercharger supplies only little power, it may occur that, because of its mass, it causes a decrease of rather than a contribution to the power of the expansion engine. Except for its scavenging function, it is better in that case that the supercharger funs without load. In this case, the efficiency of the expansion engine is only dependent on the functioning of the cylinders and, because of the relatively low expansion degree which then remains, this function supplies a much smaller efficiency than is the case in co-operation with the pre-compression and the after-expansion in the supercharger.

A reduction of the filling, however, automatically increases the compression ratio in the cylinders, so that a greater efficiency is still obtained. In this case, however, the drop or even total disappearance of the presupercharging pressure reduces to much lower than normal the working pressure in the combustion installation.

The above-described regulation device can then not be derived from the pressure in the combustion engine by a mechanical regulation with springs. With the electric regulation according to FIG. 4, this can be overcome by allowing enough space for the contact point 30.

On the average, at up to three-fourths of the power of the expansion engine, the aspiration of fresh air from the outside can be limited to such an extent, that so much air is aspired, that the expansion in the supercharger in last instance can be continued until the outer air pressure. As will be explained with reference to FIG. 5, this will then give an improvement of the efficiency of some percents, because the supercharger can then supply more power.

Figure 5:
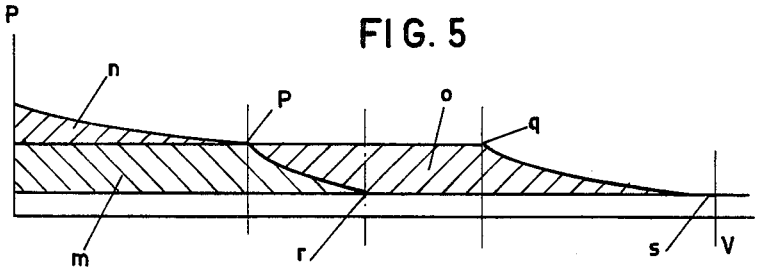
FIG. 5 shows a pv-diagram of a particular supercharging regulation.

In the pv-diagram of FIG. 5, *m* indicates the compression- and expulsion-energy, *n* indicates the expansion energy until equal pressure and *o* indicates the extra expansion energy. The line *p–q* shows the return supply of the expulsion energy, whereas the line *r–s* indicates the reduction of the aspiration.

The reduction of the air aspired by the supercharger can be carried out by means of a regulation device operated by a lever, or it can be regulated in a variable way as a derived function of the variable regulation of the mechanical filling.

It is observed that the supercharger may e.g. consist of an extra pressure phase which is interposed with respect to the compression and postponed with respect to the expansion, said pressure phase being coupled with the axis of the expansion engine out of a fast turning piston engine coupled with this axis. It is also possible that it consists of a compression-expansion coupled with the axis, which compression-expansion engine uses its energy surplus to compress the air to the working pressure of the engine and to supply this extra air as extra filling to the cylinder, in such a way, that this air can serve to enable a high average effective piston pressure (interim supercharging). Instead of a supercharger coupled with the axis of the expansion engine, a supercharger can be used, which consists of a turboset, which is not coupled with the axis of the expansion engine and which (notwithstanding its supercharging function) uses its energy surplus to compress air to the working pressure of the expansion engine and to supply said extra air as extra air to the cylinders, in such a way, that this air can serve to obtain, without a rise of temperature, an extra great filling of the cylinders, whereas, as a result of not being coupled with the axis of the expansion engine, the regulation may be such, that the supercharger functions with about the same speed and supplies the necessary pre- and interim supercharging air in ratio to the speed of the expansion engine by means of filling a variable number of the provided blade wheels in such a way that the compression wheels are inserted or short-circuit dependent of the number of wheels which are filled for expansion in ratio to the present exhaust gas of the expansion engine, through a derived regulation.

The regulation of the increase of the mechanical filling is only useful at maximum cooling of the supercharging air, because other wish the working temperature becomes too high, and is further also only useful in view of extra loading the engine, because at normal load the working pressure and thus the efficiency becomes thereby too low. So, this regulation must connect to the point where the cooling is fully in operation. When nevertheless extra fuel is supplied, the working pressure tends to rise. In addition to the mechanism which regulates the cooling, a mechanism can be provided which starts to function at a further tendency of the pressure to rise, and which increases or reduces again the mechanical filling and brings it back to the original level before the cooling is reduced.

The regulation for reducing the mechanical filling can connect to the same device for the regulation of the supercharging cooling, as well as that for increasing the filling, but now starting to function at the tendency of the working pressure to drop, after the cooling has been entirely switched off.

The regulation to decrease the supercharging pressure implies that the working pressure drops. If this regulation in co-operation with the above-described regulations is also to be used in a mechanical regulation method, an intermediate regulation device must therefore be provided for adapting the pressure ratio. This regulation to reduce the supercharging pressure can further be derived from the decrease of the mechanical filling. In this case the supercharging pressure is reduced, because at a smaller mechanical filling the exhaust pressure of the engine is reduced so much, that no complete use can be made of the expansion space of the supercharger. This method then serves to put the supercharger partly out of operation, for which purpose such means as e.g. relief valves must be provided, operated in derived function of the reduction of the mechanical filling.

Besides a regulation derived from the pressure in the heater, it is also possible to derive this pressure from the temperature in the heater. Just as the working pressure remains constant during the operation of these regulations, apart from the one without reduction of the mechanical filling, also the combustion temperature remains the same (favourable for the purity of the combustion) and this also applies to the case in which the mechanical filling is variable.

The charging pressure can also be made variable, without the mechanical filling being reduced, in order to obtain a kind of economizer-effect at a certain cross speed. This economizer-effect is based on shortening the compression stroke of the supercharger (reduction of the volume) so that the expansion part may further expand until the pressure of the outside air is just reached. Thereby the efficiency rises a few percents. This regulation can be switched on or off by a separate handle. It can also be integrated variably in the total regulation system, namely be derived from the tendency to rise, respectively to drop, of the working temperature, with priority for the regulation to increase the mechanical filling.

It is obvious, that the invention is not restricted to the embodiments as described above and as shown in the drawing, but that numerous modifications are possible within the framework of the invention.

I claim:

1. Expansion engine apparatus comprising an expansion engine;

a separate combustion device having inlets for combustion air and for fuel, an ignition device for igniting said fuel, and an outlet for combustion gas connected to a combustion gas inlet on said expansion engine;

a supercharger for precompressing combustion air;

a cooling device connected to receive said combustion air from said supercharger and supply said combustion air to said combustion device through said inlet for combustion air in said combustion device, and also having an inlet and an outlet for a cooling medium;

characterized by a sensitive element influenced by changes in said combustion gas in said combustion device;

and a cooling air control means disposed in said inlet for said cooling medium of said cooling device and actuated by said sensitive element, for cooling said combustion air precompressed by said supercharger and supplied to said combustion device to maintain the pressure of the combustion gas substantially constant within the normal power region of the expansion engine apparatus.

2. Expansion engine apparatus according to claim 1, further characterized by said sensitive element influenced by pressure changes in said combustion gas in said combustion device.

3. Expansion engine apparatus according to claim 2, further characterized by said sensitive element including a casing which is connected to said combustion device by a pipe, a spring-biassed plunger arranged to extend into said casing, said plunger having a cam or collar at both its ends, a rod connected to said plunger to operate said cooling air control means.

4. Expansion engine apparatus according to claim 2, further characterized by said sensitive element including a manometer connected to said combustion device, said manometer co-operating with two contacts, each of which is arranged in an electric circuit connected to a servomotor which operates said cooling air control means.

5. Expansion engine apparatus according to claim 4, further characterized by said sensitive element further including a further contact provided at both sides of the first mentioned contacts, each of said further contacts arranged in an electric circuit connected to said servomotor.

6. Expansion engine apparatus according to claim 1, further characterized by said sensitive element influenced by temperature changes in said combustion gas in said combustion device.

7. Expansion engine apparatus according to claim 1, further characterized by a further inlet in said expansion engine connected to receive the combustion air from said cooling device, a further outlet in said expansion engine connected to supply combustion air through said inlet for combustion air in said combustion device to said combustion device.

* * * * *